United States Patent [19]

Porzio

[11] Patent Number: 4,894,811

[45] Date of Patent: Jan. 16, 1990

[54] OUTBOARD-DRIVEN FLEXTENSIONAL TRANSDUCER

[75] Inventor: Raymond Porzio, Narragansett, R.I.

[73] Assignee: Raytheon Company, Lexington, Mass.

[21] Appl. No.: 51,336

[22] Filed: May 18, 1987

[51] Int. Cl.[4] ..... H04R 17/00; H04R 15/00

[52] U.S. Cl. ..... 367/174; 367/155; 367/156; 367/163; 310/334; 310/337

[58] Field of Search ..... 367/15, 141, 153, 155, 367/156, 159, 160, 163, 173, 174; 181/110; 310/323, 328, 334, 337

[56] References Cited

U.S. PATENT DOCUMENTS 3,160,769 12/1964 Abbott ..... 310/26
4,420,826 12/1983 Marshall et al. ..... 367/167
4,524,693 6/1985 McMahon et al. ..... 367/163
4,642,802 2/1987 Pozzo et al. ..... 367/156
4,742,499 5/1988 Butler ..... 367/155

*Primary Examiner*—Deborah L. Kyle
*Assistant Examiner*—J. Woodrow Eldred
*Attorney, Agent, or Firm*—Richard M. Sharkansky

[57] ABSTRACT

A flextensional transducer having an elliptically-shaped shell is compressed at its ends by either piezoelectric or magnetostrictive drive assemblies which are constrained from longitudinal movement by a rigid mount. The compression may be provided by a rigid mount having a gap into which a distended shell and the drive assemblies are inserted. After removing the force producing the distended shell, the mount exerts a compressive force on the ends of the shell. Alternatively, the compression of the shell may be obtained by mechanical forces produced by screw mechanisms forming part of the mount.

22 Claims, 7 Drawing Sheets

70

OUTBOARD-DRIVEN FLEXTENSIONAL TRANSDUCER

BACKGROUND OF THE INVENTION

This invention relates to sonar transducers and more particularly to a flextensional transducer. There exists a need in underwater acoustics for an efficient light-weight, small relative to a wavelength, high power, high duty cycle, very low frequency source for single element or line array applications. The transducer types which are presently available are hydro-acoustic sources, variable reluctance transducers, hoop mode ring devices, and flexural mode transducers. The first three of these transducer types are considered to be less desirable for various reasons than the flexural mode transducers.

Although there are many types of flexural transducers, the flextensional transducer has been demonstrated to be exceedingly useful for low frequency applications. FIG. 1 shows an isometric view of a prior art Class 4 flextensional transducer 10. The common characteristic which makes all flextensional transducers efficient radiators of power at low frequencies is large displacement over a relatively large surface area. The elliptical geometry of the shell 11 is such that it provides a lever-type action which amplifies the displacement of the flattened (diaphragm) region 12 of the shell 11 resulting from the longitudinal movement of the ends 13 caused by the electrical energization of the ceramic drive stack 14 produced by alternating current energization of the wires 15 from a source (not shown). The mechanical transformer effect which converts small longitudinal motion of the ends 13 into a relatively large transverse motion of the diaphragm regions 12 also results in enhanced compliant and inertial loading enabling the flextensional transducer 10 to achieve a low resonance frequency in a very light-weight package. In addition, flextensional transducers which have piezoceramic drive stacks 14 typically have efficiencies in excess of 70%. The interior of the flextensional transducer 10 is maintained water-tight by cover plates 15 which are held in compression against rubber gaskets 16 by bolts 17 threadedly connected into the threaded holes 18 of support 19 to form a water-tight enclosure. Additional supports 19 may be used to compress cover plate 15 against gaskets 16 to allow a thinner cover plate 15 to be used while continuing to provide a water-tight interior. The interior of the transducer 10 is at normal atmospheric pressure when assembled and made water-tight.

The conventional air-backed flextensional transducer 10 is, however, limited in certain respects:

The mechanical compressional prestress applied to the ceramic drive assembly 14 in order to achieve high power operation is supplied by means of a force F which compresses the shell 11 at the diaphragms 12 thereby extending the space between the ends 13. Insertion of shims 21 between the shell ends 13, the support 19, and the drive assembly 14 and release of the force F causes the shell 11 to relax toward its non-prestressed state thereby compressing the drive assembly 14. During deployment, as the operational depth and hence the hydrostatic pressure of the water in which the flextensional transducer is immersed increases, the shell 11 is flattened by the force of the water pressure on the diaphragms 12 and the mechanical prestress is diminished. This results in a degradation in acoustic output power due to stress limitations with increasing water depth and severely limits the transducer 10 depth capability. Fluid and compliant tube pressure compensated device designs have been utilized to attempt to offset this effect, but these designs have all suffered from severely reduced efficiency due to excessive viscous losses.

The prior art air-backed design of FIG. 1 is frequently thermally limited to short pulses and duty cycles not exceeding 10 or 20% because of the difficulty in removing heat from the interior-mounted drive assembly 14.

While greater ellipticity (smaller spacing between diaphragms 12 relative to the ends 13) would result in greater displacement amplification and power output, ellipticity is restricted in the design of FIG. 1 because of the requirement to have sufficient space within the shell 11 to accomodate the drive assembly 14.

Since both bandwidth and resonance frequency are directly proportional to shell thickness and inversely proportional to shell circumference, the thick shell of the prior art transducer 10 which is required to maintain mechanical prestress results in a loss of bandwidth and an increase in shell longitudinal and transverse dimensions to keep down the resonance frequency.

SUMMARY OF THE INVENTION

The foregoing problems of the prior art inboard drive flextensional transducer are overcome and other objects and advantages are provided by a transducer constructed in accordance with this invention. This invention comprises an outboard flextensional transducer in which the drive elements are placed between the ends of the flextensional shell and a rigid support member. The drive elements and the ends of the shell are caused to be in compression under normal atmospheric pressure. The pressure is produced by either expanding the sides or diaphragms of the shell to cause the ends to move together prior to inserting the drive elements between the ends and the rigid support. Release of the force applied to the shell causes the shell ends to extend away from each other toward their unstressed conditions thereby compressing the drive elements and the shell since the rigid support body ideally does not change dimension under the force exerted by the expanding shell. Alternatively, mechanical means attached to the support body may provide a longitudinal force extending along the drive element and the axis through the ends of the shell to provide the compressive force in the shell and the drive elements. In operation, submerging the transducer at ocean depths causes the water pressure to compress the diaphragms of the shell to increase the pressure on the shell and the drive elements rather than decreasing the compression on the drive elements as in the prior art.

Since the drive elements are external to the shell, water cooling of the drive elements through an electrical insulating material allows greater power to be applied to the drive elements without causing them to overheat.

BRIEF DESCRIPTION OF THE DRAWINGS

The aforementioned aspects and other features of the present invention will be apparent from the following description taken in conjunction with the accompanying drawings wherein.

DESCRIPTION OF THE PREFERRED EMBODIMENTS

Figure 1:
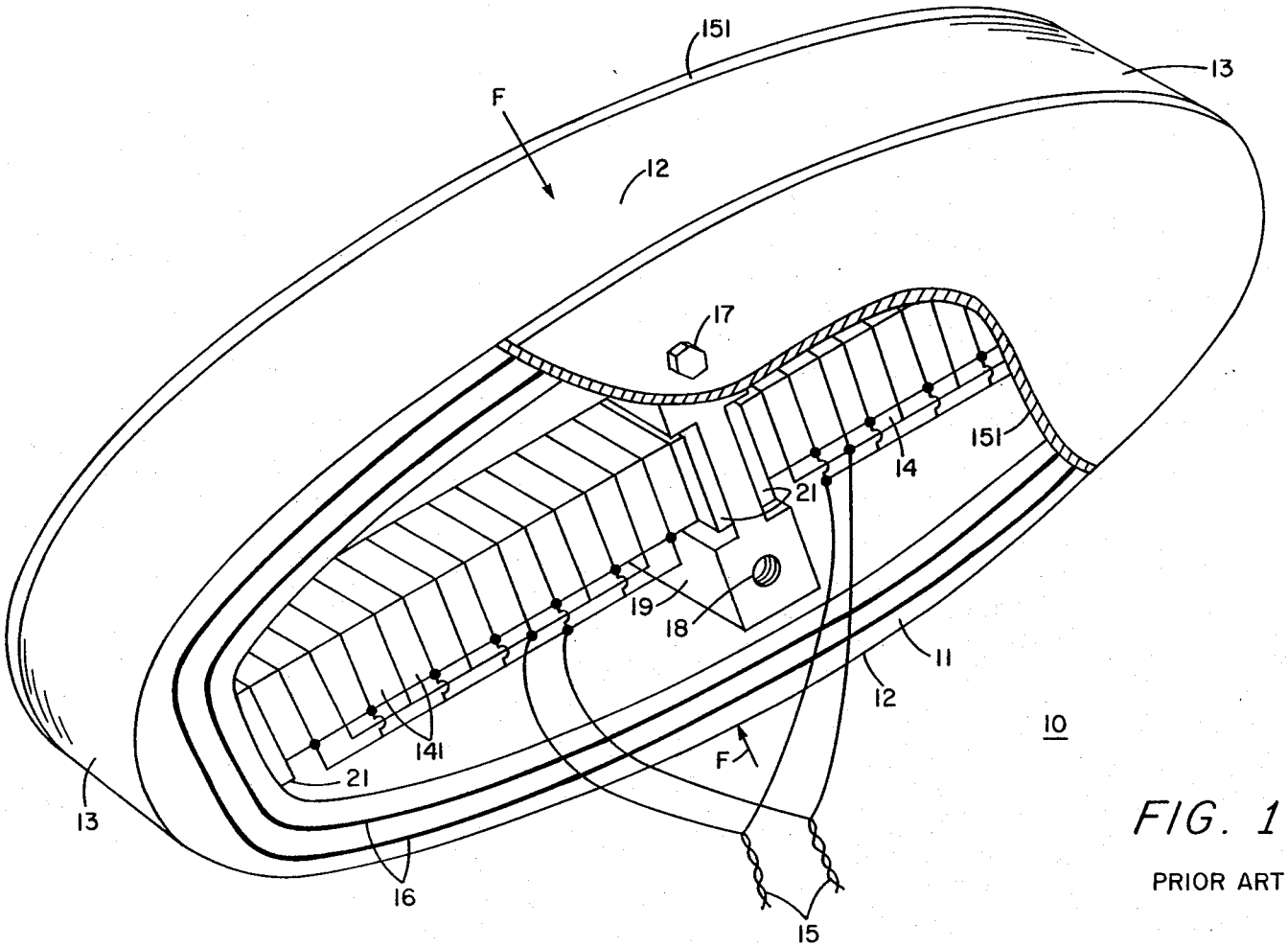
FIG. 1 PRIOR ART
FIG. 1 is an isometric view of a prior art inboard flextensional transducer.
Figure 2:
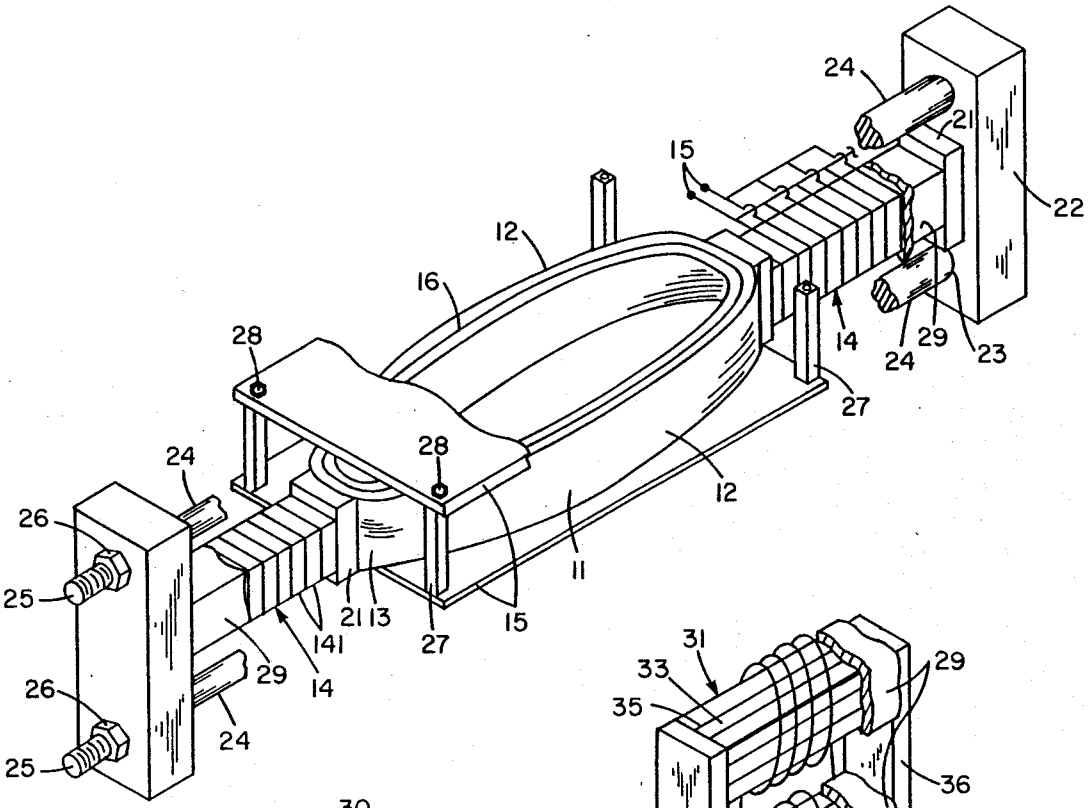
FIG. 2 is an isometric view shown partially in section of the outboard-driven flextensional transducer of this invention.

The outboard-driven flextensional transducer 30 of this invention is shown in partially-sectioned isometric view in FIG. 2. The principle of operation is the same for the prior art flextensional transducer having internal drive ceramic elements 141 in that the longitudinal displacement of the ends 13 of the drive assemblies 14 produced by electrical energization of the ceramic elements 141 constituting the drive assembly 14 produce longitudinal change in dimension of the drive assemblies which is converted by the shell 11 structure into a transverse motion of the elliptical shell 11 sides or diaphragms 12. Corresponding elements of the transducer 30 of FIG. 2 will be numbered with the same numbers as those of the inboard transducer 10 of FIG. 1. Shims 21 optionally may be inserted between the shell 11 and the drive assemblies 14 and between the end blocks 22 and the drive assemblies 14. Each end block 22 is provided with holes 23 through which pass the tensioning bars 24 having threaded ends 25. The nuts 26 on ends 25, when tightened against blocks 22, cause the drive assemblies 14 and the ends 13 of shell 11 to be compressed thereby causing the diaphragms 12 to be distended outwardly from their nonstressed positions. The amount of compressive force provided by the stressed bars 24 should be sufficient to ensure that there is sufficient compressive force exerted upon the drive assemblies 14 so that they are under compressive stress even when the polarity of the voltage applied to the ceramic elements 141 is of a polarity which causes the ceramic elements to reduce their thickness and hence reduce the length of drive assemblies 14. Covers 15 screwed into support posts 27 by bolts 28 cause the covers to be compressed against the rubber gaskets 16 to prevent water from entering the interior of the shell 11 when the transducer 30 is submerged in water. The drivers 14 are contained within a waterproof potting compound 29, a silicone elastomer for example, that is thick enough to ensure good electrical insulation, and at the same time, thin enough to provide good thermal capability for cooling of the drive assembly 14 by thermal contact with the surrounding sea water when in operation. The end blocks 22 and tension bars 24 should be sufficiently rigid so that the expansion and contraction of the drive assembly 14 is converted into flexing of the shell 11 to produce acoustic energy transverse movement by the shell diaphragms 12 with minimum energy being lost in the elongation and contraction of the tension bars 24 and blocks 22. Suggested materials for use as the shell 14 are high-strength aluminum, titanium, steel alloys, and high-strength composites.

Figure 3:
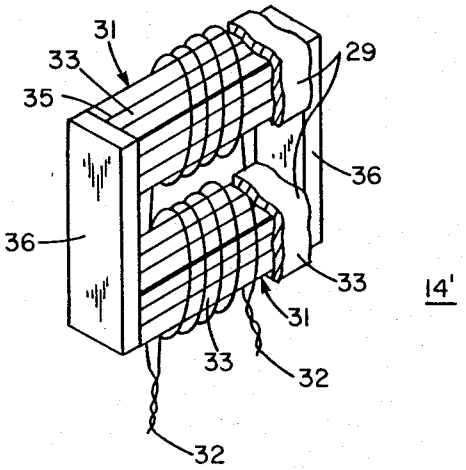
FIG. 3 shows a magnetostrictive drive assembly for alternative use in the transducer of FIG. 2.

It will be recognized by those skilled in the art that the drive assembly 14 of FIG. 2, which has been described as a stack of ceramic transducer elements 141, may be replaced by the drive assembly 14′ of FIG. 3 wherein the stack has been replaced by a bar 31 of magnetostrictive material, such as alloys of the lanthanide elements, i.e., Terfenol-D, energized by a wire coil 32 connected to a source of current (not shown). The bar 31 may, as shown in FIG. 3, be made up of a group of smaller cross-section bars 33 which are electrically insulated from one another by insulation 35 to reduce eddy current losses. Ferromagnetic bars 36 of high permeability, preferably of electrically insulated laminated sheets of steel, complete the magnetic path of the bars 31. The magnetostrictive bar 31 is longitudinally compressed in the same manner as were the stack of ceramic elements 141 and the magnetic field applied by the coil 32 will be appropriately biased and energized by DC and AC current, respectively, as is well known to those skilled in the art. Waterproof insulation 29 coats the wires of coil 32 of the magnetostrictive driver 14′ to provide electrical insulation. The insulation 29 also has good thermal conductivity properties in order to carry away the heat generated in the coil and the magnetostrictive bar 31 to the surrounding water when the transducer is in operation. Hence, in the outboard-driven flextensional ring transducer 30 of FIG. 2, waste heat is readily removed, and high duty cycle or continuous duty operation is readily obtainable with either form of drive assembly 14, 14′ of FIG. 2 or FIG. 3, respectively.

Figure 4:
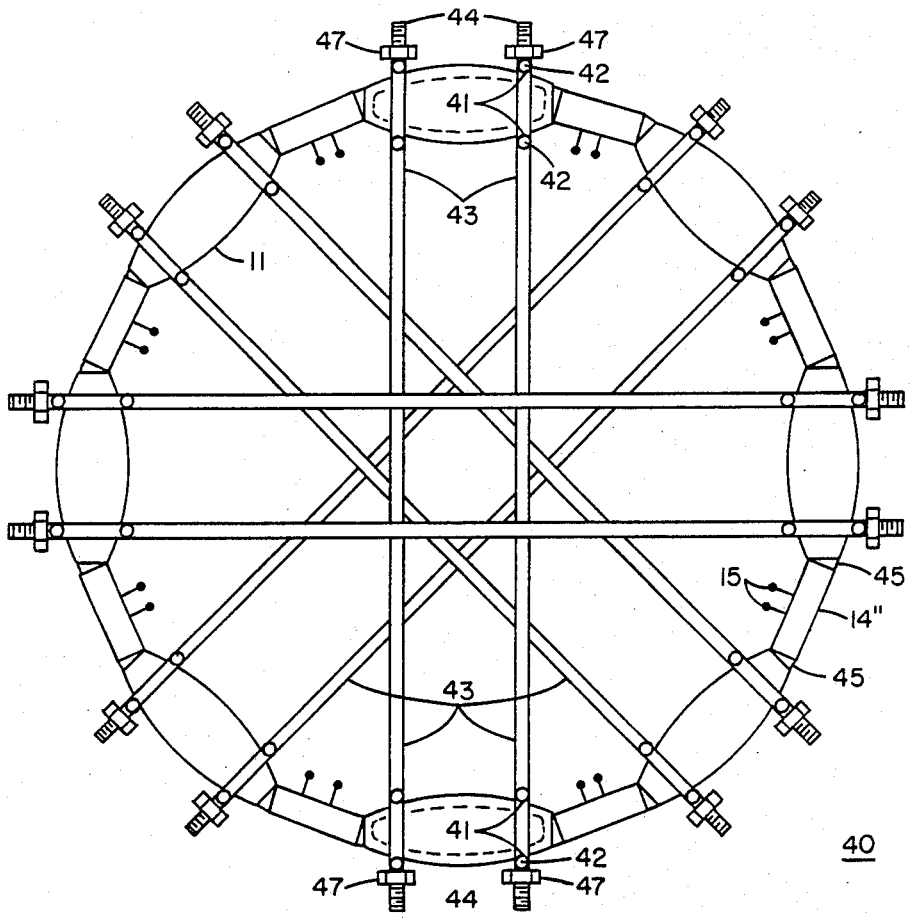
FIG. 4 is a transducer configuration having a plurality of flextensional shells.

FIG. 4 shows a top view of an octagonal form 40 of a ring transducer from an assembly of outboard-driven flextensional transducers wherein the shells 11 are driven by either piezoceramic or magnetostrictive drive assemblies 14″. The octagonal transducer 40 shows the shells 11 mounted at their flexural node lines 41 by lateral tie rods 42. The lateral tie rods 42 are in contact with the shell 11 through an elastomer 44 along the flexural node lines 41 of shell 11 and are maintained in contact with the shell under a moderate amount of pressure by the lateral tie rods 42. Cross-bracing (not shown) is used between the radially extending tie rods 43 to stiffen the structure and prevent unwanted vibrational modes. In the octagonal structure of FIG. 4, a compressional force is exerted on the drive assemblies 14″ and the shells 11 by tightening the nuts 47 on the threaded ends of the tie rods 43. Wedges 45 fill the gap between the transverse ends of the drive assemblies 14″ and the shells 11.

Figure 5:
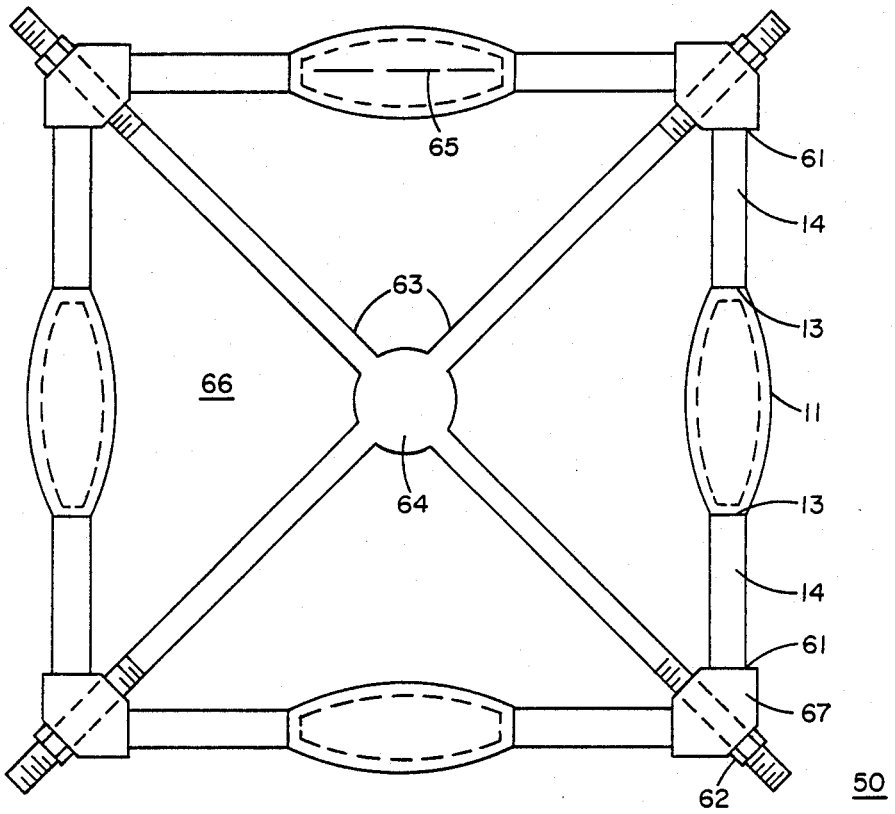
FIG. 5 shows a detailed view of an illustrative structure for mounting the flextensional shells to provide compressional force on the intervening drive elements.

FIG. 5 shows a top view of an assembly 60 of shells 11 in which mounting by corner blocks 67 occurs at longitudinal nodal points 61 of the shell 11 and drive assemblies 14 at each end 13 of shell 11. Compression on the drive assemblies 14 is obtained by tightening against corner posts 67 each of the nuts 62 on the threaded rods 63 which are connected to a center post 64. The longitudinal nodal mounting method which produces the ring transducer 50 uses a lesser number of component shells 11 than that of the flexural node assembly of FIG. 4. The bars 63 and the central post 64 serve as support members and suppress the hoop mode by keeping the line of action of the drive elements 14 directed parallel to the longitudinal axis 65 of the flextensional shells 11. The space 66 within the shells 11 and the drive assemblies 14 can be utilized to house tuning and other electronic components (not shown) ancillary to operation of the transducer assemblies 40 and 61. In the designs of FIGS. 4 and 5, it is important that the longitudinal compliance of the structural bulkheads provided by rods 43 and 63 be much less than the combined compliance of the flextensional shells 11 and drive assemblies 14 to avoid excessive degradation of the effective transducer electromechanical coupling factor. One technique for reducing longitudinal compliance is to make the bars 43, 63 of high strength materials having a high modulus of elasticity and by having the diameter of the bars of maximum practical size.

Figure 6:
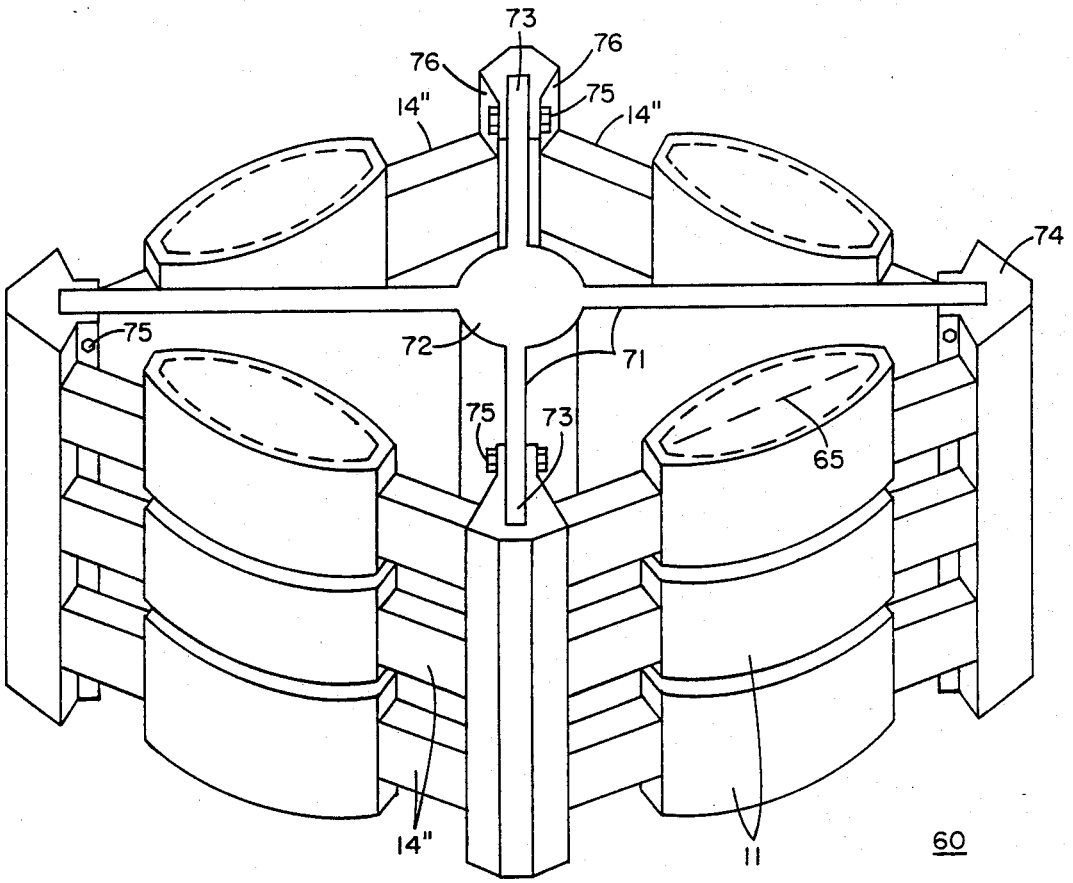
FIG. 6 is an isometric view of a ring transducer having multiple transducers in parallel arrangement.

The transducer of FIG. 5 may be modified as in FIG. 6 by having a plurality of shells 11 each driven by a drive assembly 14, or alternatively, there may be a single shell driven by a plurality of drive assemblies 14. FIG. 6 shows an isometric view of a modified form of ring transducer where the tie rods 63 of FIG. 5 are replaced by bulkheads 71 connected to a central post 72. The outer ends 73 of the bulkheads 71 are connected to nodal masses 74 by bolts 75. The faces 76 of nodal masses 74 are transverse to the longitudinal axis 65 of the flextensional shells 11 and of the drive assemblies 14''. Relaxation of an outward applied force to the diaphragms 12 after assembly as shown in FIG. 6 causes compressional forces to be exerted upon the ends 13 of the shells 11 and drive assemblies 14''. The mass obtainable by the use of the bulkheads 71 assures compliance with the desire to minimize longitudinal compliance of the structural bulkheads 71 without excessive thickness of the bulkheads 71.

Figure 7:
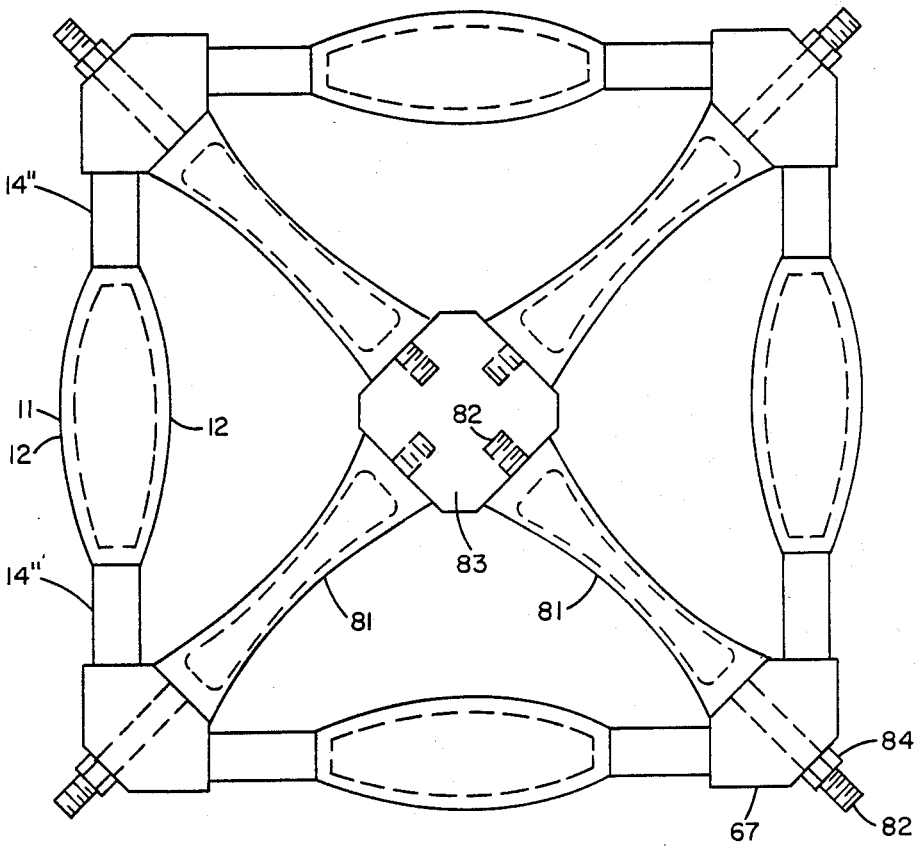
FIG. 7 is a top view of a combination of convex and concave flextensional transducers to form a ring transducer.

FIG. 7 shows a top view of another design of a ring transducer assembly 70 in which the structural bulkheads 71 of FIG. 6 have been replaced with concave flextensional shells 81. The rods 82 which extend through the hollow interior of the shells 81 have threaded ends, one end being screwed into the center post 83 and the other end being threadedly connected to nuts 84. Tightening of the nuts 84 against corner posts 67 causes the shells 11 and 81 together with the drive assembly 14 to be compressed to the desired degree of compression. In the transducer assembly 70, the concave flextensional shells 81 are allowed to undergo flexural vibrations since the radiation emitted by the concave external surfaces 84 of the inboard flextensional shells 81 will be in phase with the convex external surfaces 12 of the flextensional shells 11 in the outer ring of the assembly 70 formed by the shells 11, the drive assemblies 14, and the corner posts 67 upon which the nuts 84 exert pressure when the rods 82 are tensioned. In the assembly 70, hoop mode vibration occurring at the longitudinal nodes at the corner posts 67 is used to induce flexural vibrations in the inner flextensional shells which also radiate acoustic power. The inner shells 81 can be designed to resonate at the same resonance frequency as the outer shell 11, driver assembly 14 combination, or at another frequency so as to improve the overall bandwidth of the assembly 70.

Figure 8:
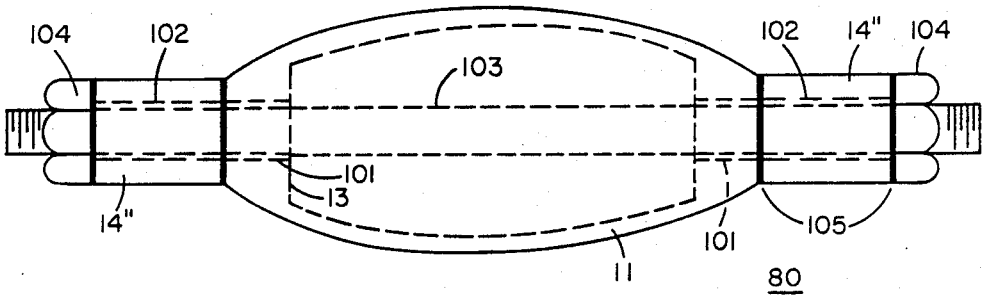

FIG. 8 shows a top view of another embodiment 80 of the invention where the shell 11 has holes 101 in its ends 13 together with holes 102 in drive assemblies 14'' through which a tensioning rod 103 passes. Nuts 104 on each end of the threaded rod 103 are used to provide the desired amount of compression on drive assemblies 14'' and shell 11. Seals 105 prevent water from entering shell 11 which has waterproof covers 151 (not shown).

Figure 10:
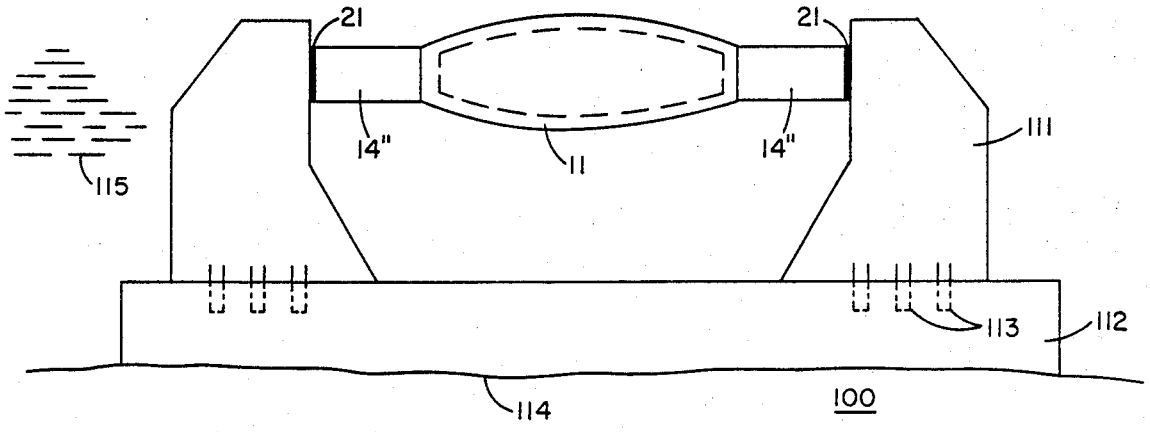
FIGS. 8, 9, and 10 show side views of other forms of externally-driven flextensional transducers.
Figure 9:
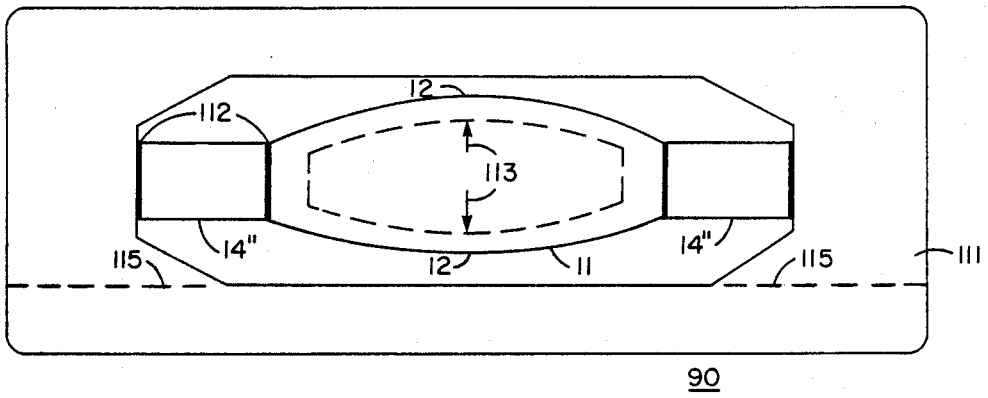

For those installations where compression of the flextensional shell 11 is to be provided without the use of tensioning rods and adjusting screws, the transducer assembly 90 of FIG. 9, shown in side view, might be used instead where the yoke 111 totally encompasses the flextensional shell 11 and drive assemblies 14''. Shims 112 may be used to adjust the compression desired. Application of opposing forces to the diaphragms 12 along direction arrows 113 and the insertion of shims 112 of the desired thickness will produce the desired amount of compression of the shell 11 and drive assemblies 14'' after removal of a mechanism for producing the force along direction arrows 113. The yoke 111 need not totally encompass the shell 11 as shown in FIG. 9, but only a portion thereof as shown in the side view of transducer 100 of FIG. 10. It is also apparent that the portion of the yoke 111 below the dashed line 115 of FIG. 9 could be of concrete 112 with the remainder of the yoke 111 being of steel anchored to the concrete by pins 113 when the transducer assembly 100 is intended to be mounted in the ocean 115 on the sea floor 114 where both the shell 11, drive assemblies 14'', and yoke 111 may be of massive proportions in order to provide very low acoustic frequency energy into the surrounding ocean. In all transducers of this invention, the yoke assemblies should provide very high mechanical impedance to avoid excessive degradation of the effective electromechanical coupling factor of the various transducers herein described.

In summary, this invention provides a transducer where the exposure of the drive assembly to the water environment in which the transducer is used results in much greater cooling and higher duty cycle/continuous duty capability compared to prior art flextensional transducers. Further, the drive assembly experiences increased compression with increased depth rather than a loss of compression as in the prior art. This results in an increased depth capability compared to traditional Class IV flextensional designs. The flextensional shells can be flatter ellipses which radiate more efficiently since space for a drive assembly inside the shell is not required as in the prior art. The flextensional shells of this invention can be made thinner and smaller for a given frequency since a small amount of deformation by water pressure is allowable and does not result in the loss of mechanical prestress in the drive assembly. As with conventional flextensional ring transducers, this invention can also be driven with the drive assemblies out of phase with each other to form dipole, quadrapole, octapole, etc. beam patterns for left/right target ambiguity resolution and other more extensive target resolution. Compared to hoop mode ring transducers, the outboard driven flextensional ring transducer of this invention is lighter in weight due to the large bending inertia and compliance of the flextensional shells. The transducer of this invention is more efficient and produces greater source levels than hoop mode devices of the prior art since both the inner and outer sides of the radiating flextensional shell radiate in phase when the element is free-flooded. In a free-flooded hoop mode device, the out of phase radiation from one side is out of phase with radiation from the other side and must be suppressed to avoid phase cancellation.

The outboard-driven flextensional ring transducer of this invention can be used in any application where long duty cycles, high powers, and high efficiencies are required at very low frequencies. Hence, they can be used as targets, calibration sources and shipborne tactical and surveillance line arrays, in helicopter-dipped arrays, and for underwater communications. The outboard-driven flextensional/yoke assembly configuration can be used in a way similar to the ring-type configuration, but the total mass per unit power of the device will be higher. The outboard-driven flextensional/yoke assembly is especially useful in communications, surveillance, and calibration sonars that can be mounted on the sea floor.

Having described a preferred embodiment of the invention, it will be apparent to one of skill in the art that other embodiments incorporating its concept may be used. It is believed, therefore, that this invention should not be restricted to the disclosed embodiment but rather should be limited only by the spirit and scope of the appended claims.

What is claimed is:

1. A flextensional transducer comprising:

a compressible shell having an inner and outer surface;

an electromechanical drive in contact with the outer external surface of said shell; and means for compressing said drive against said shell.

2. The transducer of claim 1 wherein:

said shell is elliptical in shape having two ends and two diaphragm portions, said contact with said drive being at least at one end of said shell.

3. The transducer of claim 2 wherein:

said drive comprises a first and second stack of ceramic electrostrictive elements, one stack of said elements at each end of said shell.

4. The transducer of claim 2 wherein:

said drive comprises a first and second magnetostrictive drive, one magnetostrictive element at each end of said shell; and a first and second coil encompassing said first and second magnetostrictive drive, respectively.

5. The transducer of claim 2 comprising in addition:

said shell having substantially planar opposed sides transverse to said elliptically-shaped portion thereof;

said sides having a continuous elliptical groove in each side;

an elastomeric sealing ring in each of said grooves;

cover plates;

means for compressing each of said cover plates against each sealing ring to provide a watertight enclosure within said shell.

6. The transducer of claim 2 wherein said means for compressing comprises:

a rigid mount having opposed faces;

said shell and said drive being held in compression against each other by said rigid mount.

7. The transducer of claim 2 wherein said means for compressing comprises:

a pair of blocks in contact with said electromechanical drive;

means for forcing said blocks against said drive to provide a compressional force on said drive and said shell.

8. A ring transducer comprising:

a plurality of elliptically-shaped shells, each shell having two opposed ends;

a plurality of electromechanical drives, each in contact with an end of a different shell;

said drive and said shells forming a ring of alternate drives and shells;

each shell having nodal lines on the elliptical surface of said shells;

each of said nodal lines being a line of minimum expansion and contraction of said shell in response to a force applied to its ends;

means for making contact with said shells at at least one point along the nodal lines on the outer periphery of said ring of shells;

means for compressing said contact means against said contacted nodal lines to thereby cause each of said drives and each of said shells to be compressed at their ends.

9. A ring transducer comprising:

a plurality of elliptically-shaped shells, each shell having two opposed ends;

a plurality of electromechanical drives at least one drive being in contact with at least one end of a shell to provide contacting drives and shells;

a plurality of corner blocks;

each said corner block being between said contacting drives and shells to thereby form a ring; and means for compressing said corner blocks against said contacting drives and shells.

10. The transducer of claim 9 wherein said means for compressing comprises:

radially directed holes in said blocks;

threaded rods extending through said holes; and nuts attached to said threaded rods to force said blocks to compress said contacting drives and shells.

11. The transducer of claim 9 wherein said means for compressing comprises:

a rigid bulkhead having rigid radially extending arms with said corner blocks attached to the outermost ends of said arms;

said contacting shells and drives being in compression between circumferentially adjacent corner blocks.

12. A ring transducer comprising:

a plurality of a first convexity of elliptically-shaped shells each having two ends;

a plurality of a second convexity of elliptically-shaped shells each having two ends;

a center support block;

a plurality of outer blocks;

a plurality of electromechanical drive elements;

each of said plurality of first convexity of shells having an end of at least one of said drive elements at at least one end of each said shell and an outer block at another end of each of said drive elements contacting said shell;

each of said second convexity of shells extending radially from and in contact with said center support block and one of said outer blocks;

means for forcing said outer block radially inward to compress each of said plurality of first and second convexity of shells.

13. The ring transducer of claim 12 wherein:

said first and second convexity of said shells have convex and concave external surfaces of said shells, respectively.

14. The ring transducer of claim 12 wherein:

said first convexity of shells form a ring in the shape of a square; and said outer blocks are corner blocks of said square of said first convexity of shells.

15. The ring transducer of claim 12 wherein said means for forcing comprises:

a plurality of radially-extending rods having ends;

said rods having one end connected to said center support block and extending through the interior of said second convexity of shells;

each of said outer blocks having a hole through which at least one of said rods extend;

means attached to each of said rods to compress said outer blocks against said second convexity of shells and to compress said first convexity of shells against said drive elements.

16. The ring transducer of claim 15 wherein:

each of said rods has a threaded end which passes through the hole in each of said outer blocks;

said means to compress comprises a nut attached to each threaded end of said rods to move said outer blocks radially inward when tightened on said threaded rods to thereby compress said first convexity and said second convexity of shells.

17. A flextensional transducer comprising:

an elliptically-shaped shell having ends each with a longitudinally extending hole;

at least one electromechanical drive capable of changing its longitudinal dimension and having a longitudinally extending hole;

a bar extending longitudinally through the hole of said shell and said at least one drive;

means attached to said bar for longitudinally compressing said shell and said at least one drive; and said bar being substantially unaltered in length by said means for compressing.

18. The transducer of claim 17 wherein said means for compressing comprises:

said bar having threaded ends;

a nut on each threaded end in contact with at least one said electromechanical drive and said shell.

19. The transducer of claim 1 wherein:

said compressible shell being elongated to form ends of said shell and said drive is in contact with the outer external surface at the ends.

20. The transducer of claim 19 comprising in addition:

said inner surface forming a cavity within said shell; and means for sealing air-tight said cavity.

21. A flextensional transducer comprising:

an elliptically-shaped shell having two opposed ends;

at least one electromechanical drive in contact with at least one of said shell ends; and a yoke compressing each said drive against each said ends.

22. The flextensional transducer of claim 21 wherein:

said yoke portion providing said compression is of such fixed dimension as to provide compression force on said drive and said shell.

* * * * *